US011473458B2

(12) United States Patent
Baltrucki et al.

(10) Patent No.: US 11,473,458 B2
(45) Date of Patent: Oct. 18, 2022

(54) RESPONSE TIME IN LOST MOTION VALVETRAINS

(71) Applicant: Jacobs Vehicle Systems, Inc., Bloomfield, CT (US)

(72) Inventors: Justin D. Baltrucki, Canton, CT (US); Trevor Morrissey, Cheshire, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 86 days.

(21) Appl. No.: 16/573,660

(22) Filed: Sep. 17, 2019

(65) Prior Publication Data

US 2020/0088073 A1 Mar. 19, 2020

Related U.S. Application Data

(60) Provisional application No. 62/732,353, filed on Sep. 17, 2018.

(51) Int. Cl.
*F01L 1/18* (2006.01)
*F01L 9/10* (2021.01)
(Continued)

(52) U.S. Cl.
CPC ..... *F01L 9/10* (2021.01); *F01L 1/181* (2013.01); *F01L 13/0005* (2013.01); *F01L 13/06* (2013.01)

(58) Field of Classification Search
CPC . F01L 1/181; F01L 1/18; F01L 1/2416; F01L 1/24; F01L 9/02; F01L 13/0005; F01L 13/06; F02D 13/04; F02D 1/00
(Continued)

(56) References Cited

U.S. PATENT DOCUMENTS 2,905,161 A * 9/1959 Latham ..... F01L 1/181 123/90.39
3,809,033 A * 5/1974 Cartledge ..... F01L 13/06 123/90.46

(Continued)

FOREIGN PATENT DOCUMENTS

EP 2975230 A1 1/2016

OTHER PUBLICATIONS

International Search Report for International Application No. PCT/US2019/051543 dated Dec. 17, 2019, 2 pages.

(Continued)

*Primary Examiner* — Devon C Kramer
*Assistant Examiner* — Kelsey L Stanek
(74) *Attorney, Agent, or Firm* — Moreno IP Law LLC

(57) ABSTRACT

Hydraulic systems in an engine valvetrain having lost motion and/or braking hydraulic circuits are provided with a conditioning circuit that may include a supplemental supply passage, which provides continuous and supplemental supply of hydraulic fluid from a supply source to the braking and lost motion circuits, as well as a venting of the circuits to ambient, such that the hydraulic fluid in these circuits is kept in a refreshed and conditioned state without air contamination. A vented three-way solenoid valve may be utilized. The supplemental supply passage may be provided at various locations in the valvetrain and in the engine head environment. The supplemental supply passage may include flow and pressure control devices to control the flow of the supplemental supply of hydraulic fluid.

27 Claims, 14 Drawing Sheets

(51) Int. Cl.
*F01L 13/06* (2006.01)
*F01L 13/00* (2006.01)

(58) Field of Classification Search
USPC ..... 123/90.12, 321, 322
See application file for complete search history.

(56) References Cited

U.S. PATENT DOCUMENTS

| | | | | |
|---|---|---|---|---|
| 6,394,067 | B1 * | 5/2002 | Usko | F01L 13/06 123/321 |
| 6,584,942 | B1 | 7/2003 | Albertson et al. | |
| 6,691,674 | B2 * | 2/2004 | McCarthy | F01L 13/06 123/321 |
| 2012/0024260 | A1 * | 2/2012 | Groth | F01L 13/0005 123/321 |
| 2014/0182536 | A1 * | 7/2014 | Yang | F01L 1/181 123/90.39 |
| 2014/0326212 | A1 * | 11/2014 | Baltrucki | F02D 13/04 123/321 |
| 2017/0276035 | A1 * | 9/2017 | Cecur | F01L 13/065 |
| 2019/0264584 | A1 * | 8/2019 | Baltrucki | F16K 31/607 |

OTHER PUBLICATIONS

Written Opinion of the ISA for International Application No. PCT/US2019/051543 dated Dec. 17, 2019, 3 pages.

* cited by examiner

SYSTEM OFF - VENTED CIRCUITS

SYSTEM ON - BOTH SOLENOIDS

RESPONSE TIME IN LOST MOTION VALVETRAINS

RELATED APPLICATIONS AND PRIORITY CLAIM

The instant application claims priority to U.S. provisional patent application Ser. No. 62/732,353 filed on Sep. 17, 2018 and titled IMPROVED RESPONSE TIME IN LOST MOTION VALVETRAINS, the subject matter of which is incorporated by reference herein in its entirety.

FIELD

The instant disclosure relates generally to systems and methods for actuating one or more engine valves in an internal combustion engine. More particularly, the instant disclosure relates to hydraulic systems for engine valve actuating systems, which may include lost motion components, and to systems and methods for enhancing or conditioning hydraulic circuits to improve performance.

BACKGROUND

Internal combustion engines are utilized ubiquitously in many applications and industries, including transportation and trucking. These engines utilize engine valve actuation systems that may primarily facilitate a positive power mode of operation in which the engine cylinders generate power from combustion processes. The intake and exhaust valve actuation motions associated with the standard combustion cycle are typically referred to as "main event" motions. Known engine valve actuation systems may provide for modified main event valve motion, such as early or late intake valve closing. In addition to main event motions, known engine valve actuation systems may facilitate auxiliary valve actuation motions or events that allow an internal combustion engine to operate in other modes, or in variations of positive power generation mode (e.g., exhaust gas recirculation (EGR), early exhaust valve opening (EEVO), etc.) or engine braking in which the internal combustion engine is operated in an unfueled state, essentially as an air compressor, to develop retarding power to assist in slowing down the vehicle.

Valve actuation systems may include hydraulically actuated lost motion components to facilitate engine braking and auxiliary valve motion, as well as modified main event valve motion. Lost motion is a term applied to a class of technical solutions in which the valve motion governed by a cam profile may be modified with a variable length mechanical, hydraulic or other linkage in the valvetrain. Lost motion components are well-known in the art. These devices typically include elements that may, in a controlled fashion, collapse or alter their length or engage/disengage adjacent components within a valvetrain to alter valve motion. Lost motion devices may facilitate certain valve actuation motions during the engine cycle that vary from the motion dictated by fixed-profile valve actuation motion sources such as rotating cams. Lost motion devices may cause such motion to be selectively "lost," i.e., not conveyed via the valvetrain to one or more engine valves in order to achieve events that are in addition to, or variations of, main event valve motion.

Valve actuation systems, especially valve actuation systems that utilize lost motion components, typically rely on hydraulic systems to control one or more valvetrain components. These hydraulic systems may utilize one or more hydraulic circuits, which control the flow of hydraulic fluid to, and operation of, one or more hydraulic lost motion components in the valvetrain. Hydraulic systems may be integrated with or may incorporate engine lubrication systems, typically utilizing engine oil as a hydraulic fluid.

In lost motion valve actuation systems, hydraulic circuits must have sufficiently fast and consistent response to control events, such as activation and deactivation events, initiated in the circuits. In a typical system, engine oil is supplied by an engine-driven oil pump and may be switched using solenoid valves, such as three-way solenoid valves, which supplies oil to the hydraulic circuits and vents oil from the hydraulic circuit for fast turn-off of the lost motion or engine brake lift. When vented, the hydraulic circuit is open to ambient air and depressurized. When not in use, the hydraulic circuit will bleed down with oil and may partially fill with air. With rapidly reciprocating valvetrain parts connected to the braking or lost motion circuits and associated components, such as rocker shafts, rocker arms, and others, oil can drain from the circuit around various bearing clearances and part interfaces. As a result, air may enter the hydraulic circuit. After a prolonged period of inactivity, larger quantities of air may be introduced into the system. The presence of air—a poor working fluid—in hydraulic systems may negatively impact performance, including variation in response time of the circuit and variations in brake lift or lost motion responsiveness. Moreover, the consistency and predictability of the circuit's response can be affected. If the hydraulic circuit does not respond quickly and consistently to valve action, engine performance and efficiency may be impacted. In braking circuits, for example, to provide good response to decelerate a vehicle, or to provide precise control for engine RPM matching during gear shifting. It is desirable to have an engine brake respond quickly, and with consistent response time. For further example, in a Miller cycle engine system, a switching valvetrain may be used which switches from a normal compression ratio to a lower compression ratio by using early, or late intake valve closing. If the motion is not altered in the specified time, there is risk that the fuel injection will be configured improperly. Thus, variance in response times of hydraulic circuits in engine lost motion systems can have significant impact on engine performance.

An example of variability in known systems is illustrated in FIG. 3, which shows engine brake turn-on repeatability in a typical prior art system. As shown, brake turn-on repeatability time is typically in a range of 200-300 milliseconds for most activations, with outliers in a 400-500 millisecond range. These slow turn-on events may result when hydraulic circuits are contaminated with air and brake motion cannot pump up as fast as when the circuit is not contaminated with air. By eliminating air from hydraulic systems, the outliers can be eliminated and overall turn on time can be stabilized in within a tighter region.

It is known in the prior art in some engine environments to provide for bypass oil flow to purge air or gas-entrained oil. For example, systems such as those described in U.S. Pat. No. 6,584,942 provide for bypass oil flows to purge gas-entrained oil from hydraulic circuits used for the control of hydraulic lash adjusters and valve lifters in a cylinder deactivation system for internal combustion engines. Such prior art systems, however, are limited in their application to other engine environments.

For example, for hydraulic lost motion "Type III" valvetrain hydraulic environments, having center-pivot rockers on a common rocker shaft, such as the type described in US Patent Publication No. 20120024260, now U.S. Pat. No.

8,936,006, there are particular challenges relating to packaging and space limitations in the engine overhead and relating to the particular configurations of hydraulic circuits for activating braking and lost motion components. Hydraulic circuits in these environments are typically characterized by limited space and intricate pathways, which are often integrated into various valvetrain components, such as rocker shafts, rocker shaft journals, rocker arms and other components.

It would therefore be advantageous to provide systems and methods that address the aforementioned shortcoming and others in the prior art.

SUMMARY

Responsive to the foregoing challenges, the instant disclosure provides various embodiments of a system for actuating engine valves having a conditioning circuit for enhancing the responsiveness of braking and lost motion circuits.

According to an aspect of the disclosure, there is provided a system for actuating at least one engine valve in an internal combustion engine comprising: a valvetrain for conveying motion from a motion source to the at least one engine valve, the valvetrain including: a rocker arm mounted on a rocker shaft and a lost motion component; a control valve for controlling the lost motion component, the control valve having an inlet for receiving hydraulic fluid from a hydraulic fluid supply source; the rocker shaft having a lost motion control flow passage for conveying hydraulic fluid between the control valve and the lost motion component; the control valve having an activated mode, wherein the control valve permits an activation flow of hydraulic fluid in the lost motion control flow passage, and a deactivated mode, wherein the control valve prevents the activation flow in the lost motion control flow passage; and a conditioning circuit adapted to provide a supplemental flow of hydraulic fluid in the lost motion control flow passage when the control valve is in the deactivated mode, the conditioning circuit including a vent for venting the supplemental flow from the control flow passage.

In one implementation, a conditioning circuit may include a supplemental supply passage, which provides continuous and supplemental supply of oil/hydraulic fluid to from a supply source to branches of braking and lost motion circuits, as well as venting of the circuits to ambient, using a solenoid valve vent, for example, such that the hydraulic fluid in these circuits is kept in a refreshed and conditioned state when the circuits are dormant or in an inactive or deactivated state or mode of operation. A vented, three-way solenoid valve in a de-energized mode provides for the venting of the braking and lost motion circuits as the supplemental supply provides flow. When the solenoid is in a de-energized state, the braking and lost motion circuits are purged with fresh hydraulic fluid and air may be purged from the circuits in a continuous manner before they are called upon to be activated by action of the solenoid valve (energization). The supplemental supply may preferably be facilitated by a flow path between a continuous oil supply passage in a rocker shaft and one or both of the braking control and lost motion control passages in the rocker shaft. Due to the parallel supply of oil and the resulting purging of air from the circuit, the system is able to provide consistent turn-on response time and consistent hydraulic working fluid composition (i.e., elimination or reduction of air or gas bubbles).

According to another implementation, a circuit configuration for two lost motion/braking circuits may include respective supplemental supply sources that are provided by supplemental flow passages to a braking circuit control passage and the lost motion control passage in the rocker shaft. Respective solenoid valves are provided.

According to further implementations, the supplemental flow paths to the hydraulic circuits have other locations within the respective circuits and may include flow control components, such as orifices, check valves and regulating devices used in conjunction with, or as part of, the conditioning circuit. A rocker shaft may have one or more mounting through holes therein. The through hole receives pressurized oil via a supply passage. A branch passage may be provided from the through hole to a braking control passage in the rocker shaft. The branch passage may comprise a single small bore, or may comprise (as shown) a larger bore tapering to a smaller bore or orifice to provide favorable flow control. Alternatively, a preconfigured orifice may be press fit into the larger bore. The larger bore 1464 and smaller bore 1466 may be conveniently manufactured using an angled drilling into the sidewall of through hole 1460. FIG. 15 illustrates a similar branch passage 1562 extending from through hole 1460 to rocker lost motion control passage 1430. The through hole, even if occupied by a hold-down bolt, provides for a supplemental flow passage of hydraulic fluid from the supply passage to the braking control passage and/or lost motion control passage.

According to yet another implementation, a conditioning circuit supplemental supply path may be provided by a bore drilled in the rocker shaft through a braking circuit passage to a depth that penetrates the wall of the supply passage, providing fluid communication between the supply passage and the braking circuit passage. A preconfigured orifice may be press-fit into the bore to provide for flow control in the conditioning circuit. The location of the bore axially on the rocker shaft is selected such that the entry of the bore is sealed by the rocker arm bushing once the rocker arm is installed therein.

According to yet another implementation, conditioning circuit configurations may be suitable for providing dependable hydraulic circuit operation where there may be challenges in maintaining oil pressure at low engine speeds. Conditioning circuits may be provided with pressure and/or flow control components to eliminate oil demand by the conditioning circuit below a pressure threshold. In one example implementation, a spring-loaded relief device may be provided to prevent flow in the supplemental flow passage of the conditioning circuit below a threshold pressure. The relief device may be a ball and spring type check valve with a seating surface, which valve prevents flow into the braking circuit unless a predetermined threshold pressure (cracking pressure) is established in the supply passage.

According to other implementations, components of the conditioning circuits may be located at specific locations within an engine or engine overhead environment. A supplemental supply flow path from the rocker shaft supply passage to the rocker shaft braking control passage may be located at a far end of the rocker shaft at a sufficient distance from the location of the solenoid that receives and vents fluid from the braking circuit rocker passage via passages in a rocker pedestal. This permits more thorough air purge from the braking circuit since conditioned hydraulic fluid from the conditioning circuit travels a larger distance and may affect a majority of the fluid within the braking circuit before venting to through the solenoid valve. According to a further example, two supplemental supply flow passages are provided at ends of the rocker shaft and the control solenoid valve is located at an intermediate location. This example configuration may provide improved air bleed due to purging of air from both the left and the right ends of the braking passage in the rocker shaft.

According to yet another implementation, supplemental flow passages may be provided in the solenoid manifold or in the rocker arm in the valvetrain. A pushrod rocker arm with a lash adjusting screw may have a threaded bore that provides a supplemental flow passage. The bore may provide fluid communication between a rocker arm fluid supply passage and a rocker arm braking fluid control passage. The small clearances between the lash adjusting screw threads and the threads in the rocker may be dimensioned so as to provide a restricted supplemental fluid flow passage.

According to yet another implementation, the supplemental flow passage for the hydraulic conditioning circuit is provided across the interface between a rocker arm and rocker shaft. An inside bore of the rocker arm may include a bushing with a through passage which permits fluid flow to or from a braking fluid control passage. Another passage through the bushing may provide for the flow of fluid from a lubrication channel on the interior surface of the bushing. The proximity of the lubrication channel and passages may permit cross-flow within the rocker shaft/bushing interface, or within the rocker shaft/rocker arm interface, of lubricating fluid from the supply passage(s) to the braking circuit passage(s). This configuration may thus provide a supplemental flow passage within the rocker shaft/rocker arm interface, which, in turn, facilitates a hydraulic conditioning circuit.

Other aspects and advantages of the disclosure will be apparent to those of ordinary skill from the detailed description that follows and the above aspects should not be viewed as exhaustive or limiting. The foregoing general description and the following detailed description are intended to provide examples of the inventive aspects of this disclosure and should in no way be construed as limiting or restrictive of the scope defined in the appended claims.

DESCRIPTION OF THE DRAWINGS

The above and other attendant advantages and features of the invention will be apparent from the following detailed description together with the accompanying drawings, in which like reference numerals represent like elements throughout. It will be understood that the description and embodiments are intended as illustrative examples according to aspects of the disclosure and are not intended to be limiting to the scope of invention, which is set forth in the claims appended hereto. In the following descriptions of the figures, all illustrations pertain to features that are examples according to aspects of the instant disclosure, unless otherwise noted.

DETAILED DESCRIPTION

Figure 1:
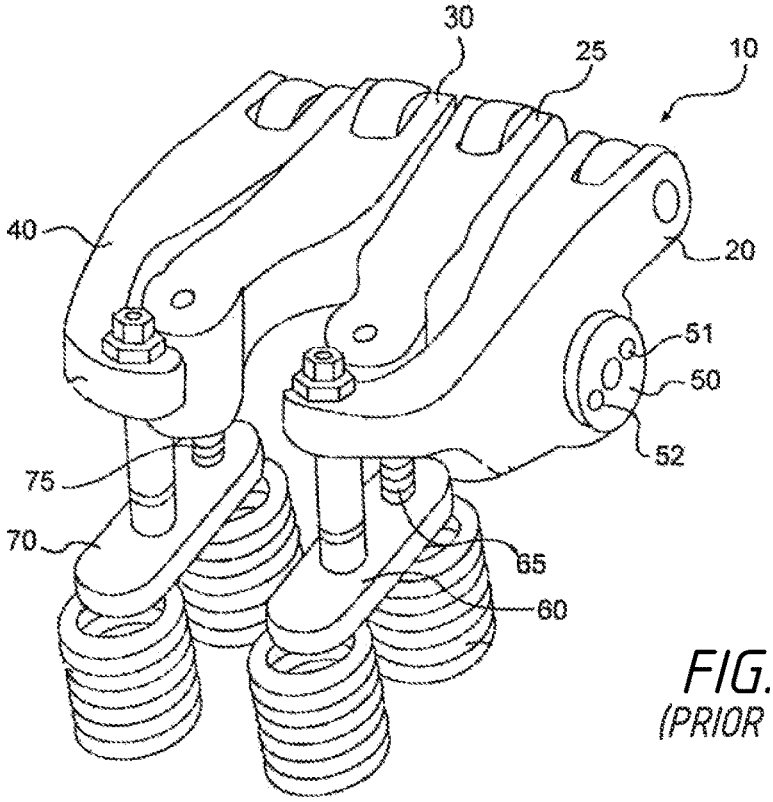
FIG. 1 (PRIOR ART)
FIG. 1 is a perspective of an example prior art engine braking configuration suitable for supporting aspects of the disclosure.
Figure 2:
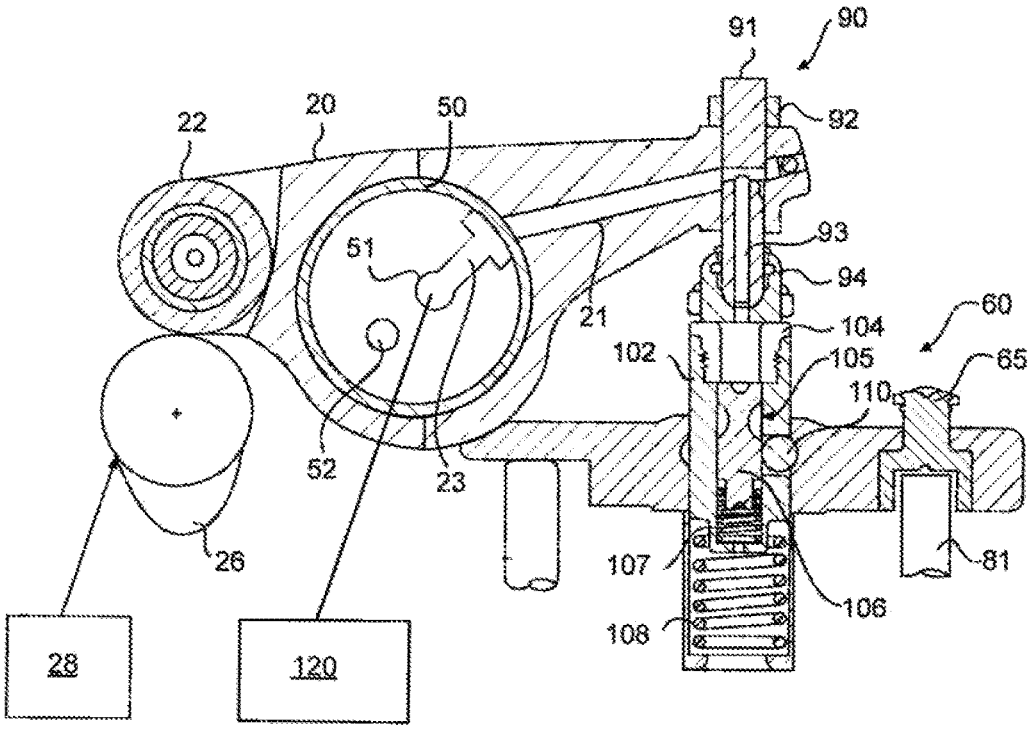
FIG. 2 (PRIOR ART)
FIG. 2 is a cross-section of a main exhaust or intake valve rocker of the configuration of FIG. 1.
Figure 3:
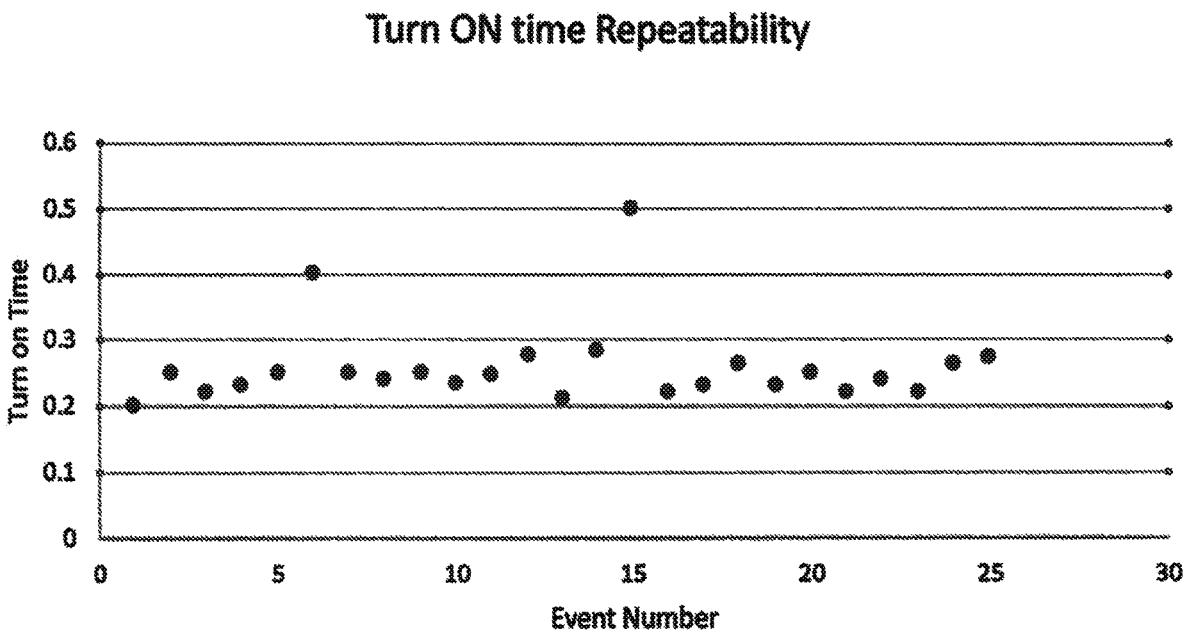
FIG. 3 (PRIOR ART)
FIG. 3 is an example graphical representation of typical turn on time repeatability of prior art engine braking configurations.

FIGS. 1-2 illustrate aspects of an example valve actuation system which may be adapted in accordance with aspects of this disclosure. Valve actuation system 10 may include a main exhaust rocker arm 20, an engine braking exhaust rocker arm 25 to provide engine braking motion to one or more exhaust valves, a main intake rocker arm 40, and an engine braking intake valve rocker arm 30 to provide engine braking motion to one or more intake valves. The rocker arms 20, 25, 30 and 40 may pivot on one or more rocker shafts 50 which include one or more passages 51 and 52 for providing hydraulic fluid to one or more of the rocker arms.

The main exhaust rocker arm 20 may contact an exhaust valve bridge 60 and the main intake rocker arm 40 may contact an intake valve bridge 70 which contacts ends of intake valve stems. The engine braking exhaust rocker arm 25 may contact a sliding pin 65 provided in the exhaust valve bridge 60, which permits actuation of only a single one of the exhaust valves 81, separately from exhaust valve bridge 60, by the engine braking exhaust rocker arm 25. The engine braking intake rocker arm 30 may contact a sliding pin 75 provided in the intake valve bridge 70, which permits actuation of only a single one of the intake valves, separately from intake valve bridge 70, by the engine braking intake rocker arm 30. Each of the rocker arms 20, 25, 30 and 40 may be actuated by cams and may include a cam roller, for example. The main exhaust rocker arm 20 may be driven by a cam that includes a main exhaust bump which may selectively open the exhaust valves during an exhaust stroke for an engine cylinder, and the main intake rocker arm 40 is driven by a cam which includes a main intake bump which may selectively open the intake valves during an intake stroke for the engine cylinder.

FIG. 2 is a cross-section illustrating details of an example main exhaust rocker 20 and valve bridge 60. It will be appreciated that the main intake rocker arm 400 and the intake valve bridge 70 a similar configuration.

With reference to FIG. 2, the main exhaust rocker arm 20 may be pivotally mounted on a rocker shaft 50. A motion follower 22 may be disposed at one end of the main exhaust rocker arm 20 and may act as the contact point between the rocker arm and the cam 26 to facilitate low friction interaction. The cam 26 may include a single main exhaust bump, or for the intake side, a main intake bump. An optional cam phase shifting system 28 may be operably connected to the cam 26.

Hydraulic fluid may be supplied to the rocker arm 20 from a hydraulic fluid supply under the control of a solenoid hydraulic control valve (not shown). The hydraulic fluid may flow through a lost motion (or braking) control passage 51 formed in the rocker shaft 50 to a hydraulic passage 21 formed within the rocker arm 20. The arrangement of hydraulic passages in the rocker shaft 50 and the rocker arm 20 shown in FIG. 2 are for illustrative purposes only.

An adjusting screw assembly 90 may be disposed at an end of the rocker arm 20. The adjusting screw assembly may comprise a screw 91 extending through the rocker arm 20 which may provide for lash adjustment, and a threaded nut 92 which may lock the screw 91 in place. A hydraulic passage 93 in communication with the rocker passage 21 may be formed in the screw 91. A swivel foot 94 may be disposed at one end of the screw 91.

The exhaust valve bridge 60 may receive a lost motion assembly including an outer plunger 102, a cap 104, an inner plunger 106, an inner plunger spring 107, an outer plunger spring 108, and one or more wedge rollers or balls 110. The outer plunger 102 may include an interior bore 22 and a side opening extending through the outer plunger wall for receiving the wedge roller or ball 110. The inner plunger 106 may include one or more recesses shaped to securely receive the one or more wedge rollers or balls 110 when the inner plunger is pushed downward. The central opening of the valve bridge 60 may also include one or more recesses for receiving the one or more wedge rollers or balls 110 in a manner that permits the rollers or balls to lock the outer plunger 102 and the exhaust valve bridge together, as shown in FIG. 2. The outer plunger spring 108 may bias the outer plunger 102 upward in the central opening. The inner plunger spring 107 may bias the inner plunger 106 upward in the inner plunger bore.

A main event deactivation circuit may be associated with the main exhaust valve rocker 20 and the main intake valve rocker 40 to activate the lost motion assembly and thereby deactivate or disable the main event valve motion. Hydraulic fluid may be selectively supplied from a solenoid control valve 120, through passages 51, 21 and 93 to the outer plunger 102. The supply of such hydraulic fluid may displace the inner plunger 106 downward against the bias of the inner plunger spring 107. When the inner plunger 106 is displaced sufficiently downward, the one or more recesses in the inner plunger may register with and receive the one or more wedge rollers or balls 110, which in turn may decouple or unlock the outer plunger 102 from the exhaust valve bridge body 60. As a result, during this "unlocked" state, valve actuation motion applied by the main exhaust rocker arm 20 does not move the exhaust valve bridge 60 downward to actuate the exhaust valves. Instead, this downward motion causes the outer plunger 102 to slide downward within the central opening of the exhaust valve bridge against the bias of the outer plunger spring 108.

Figure 4:
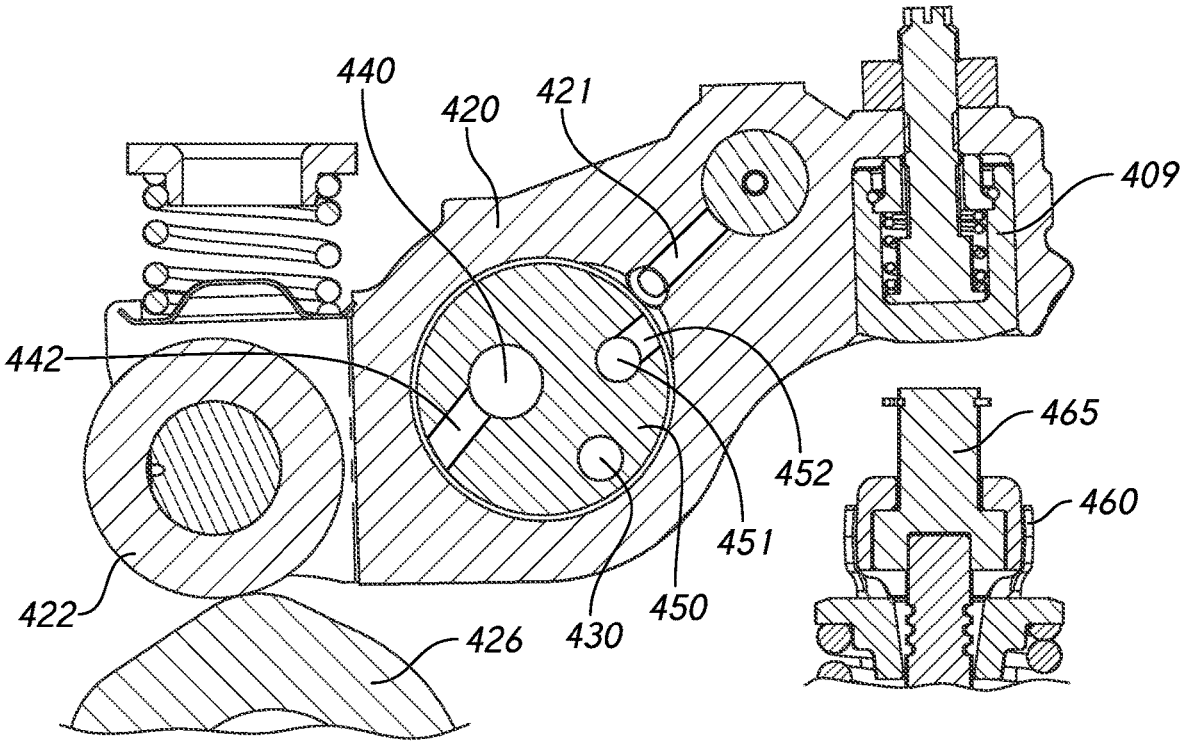
FIG. 4 (PRIOR ART)
FIG. 4 is a cross-section of another prior art valve rocker suitable for supporting aspects of the disclosure.
Figure 5:
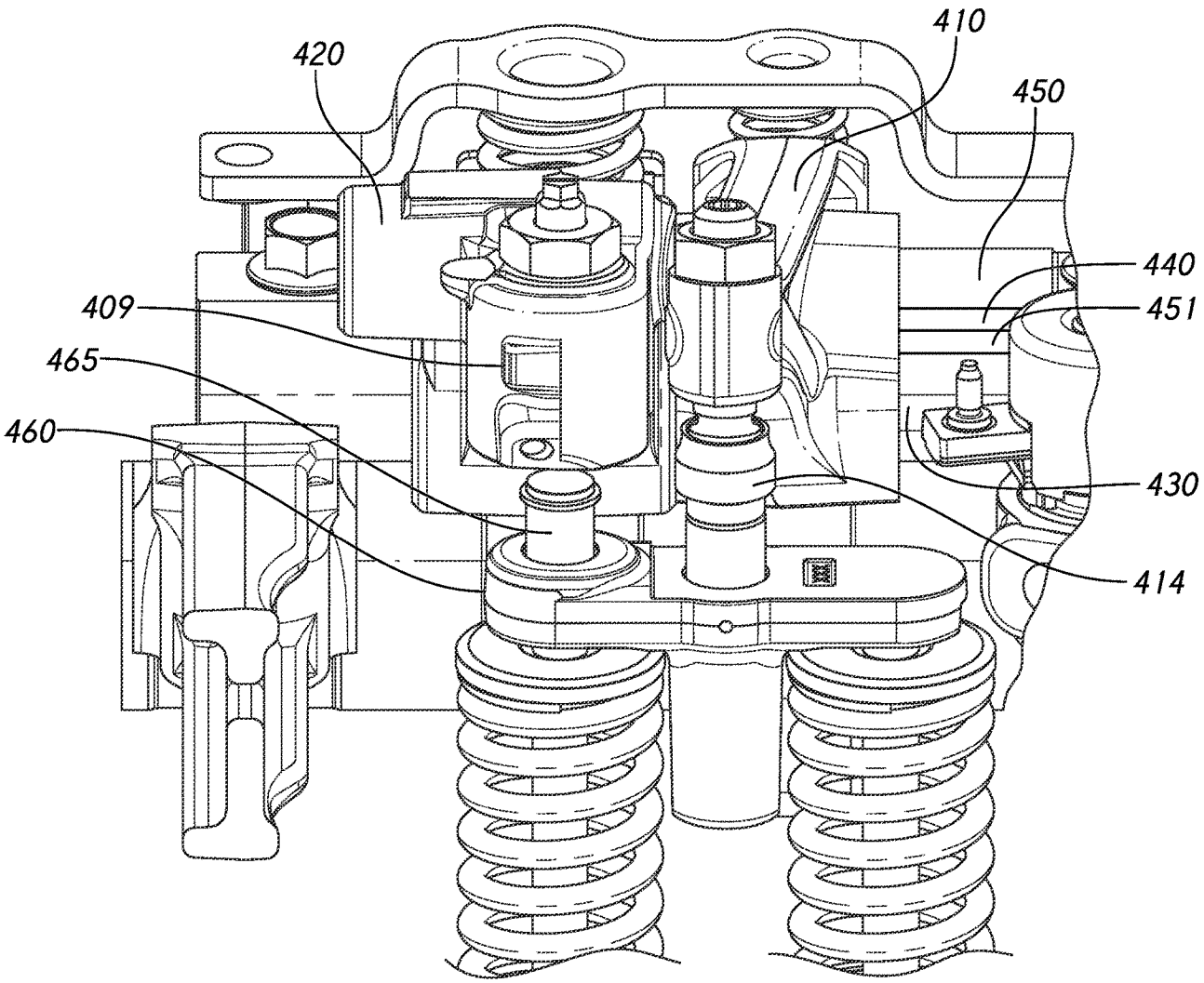
FIG. 5 (PRIOR ART)
FIG. 5 is pictorial illustration of a prior art overhead engine valvetrain, including a rocker shaft, rocker arms and lost motion components suitable for supporting aspects of the disclosure.

FIGS. 4 and 5 illustrate another example braking rocker arm system suitable for implementing aspects of the disclosure. A center pivot braking rocker arm 420 may be provided on a rocker shaft 450 and receives engine braking valve actuation motions through a cam roller from a motion source 426, which may be a cam intermediate valvetrain components, such as pushrods. A brake activation circuit may include an axial brake activation fluid passage 451, which may be a lost motion control passage, extending within the rocker shaft 450 and communicating with the exterior of the rocker shaft 450 through a braking fluid channel 452. Hydraulic fluid in the brake activation circuit flows from the channel 452 to a rocker passage 421 in the rocker arm 420 to actuate additional braking components, which may include a brake piston 409. Brake piston 409, which may be a lost motion actuator, may selectively lose or apply brake motion and may act on a brake pin 465 in a valve bridge 460 or may act on an engine valve directly. A lubrication circuit may include an axial lubrication fluid passage 440 in the rocker shaft 450 and an outwardly extending lubrication fluid channel 442, which extends to the exterior of rocker shaft 450 to provide lubrication fluid to the rocker shaft journal and other components, such as bearings, cam roller 422, elephant foot, etc. An optional lost motion circuit may include an axially extending lost motion control passage 430 in the rocker shaft 450 for providing control of lost motion components. Referring more specifically to FIG. 5, a main event rocker arm 410 may convey main event valve motion through the valve bridge 460. Valve bridge 460 may be a lost motion bridge. Main event rocker arm 410 may include a passage therein to deliver hydraulic fluid from the rocker shaft lost motion control passage 430 to the lost motion valve bridge 460 through passages in the main event rocker arm nose and elephant foot 414. The lost motion valve bridge may selectively lose motion from the cam or may optionally add motion on demand.

Figure 18:
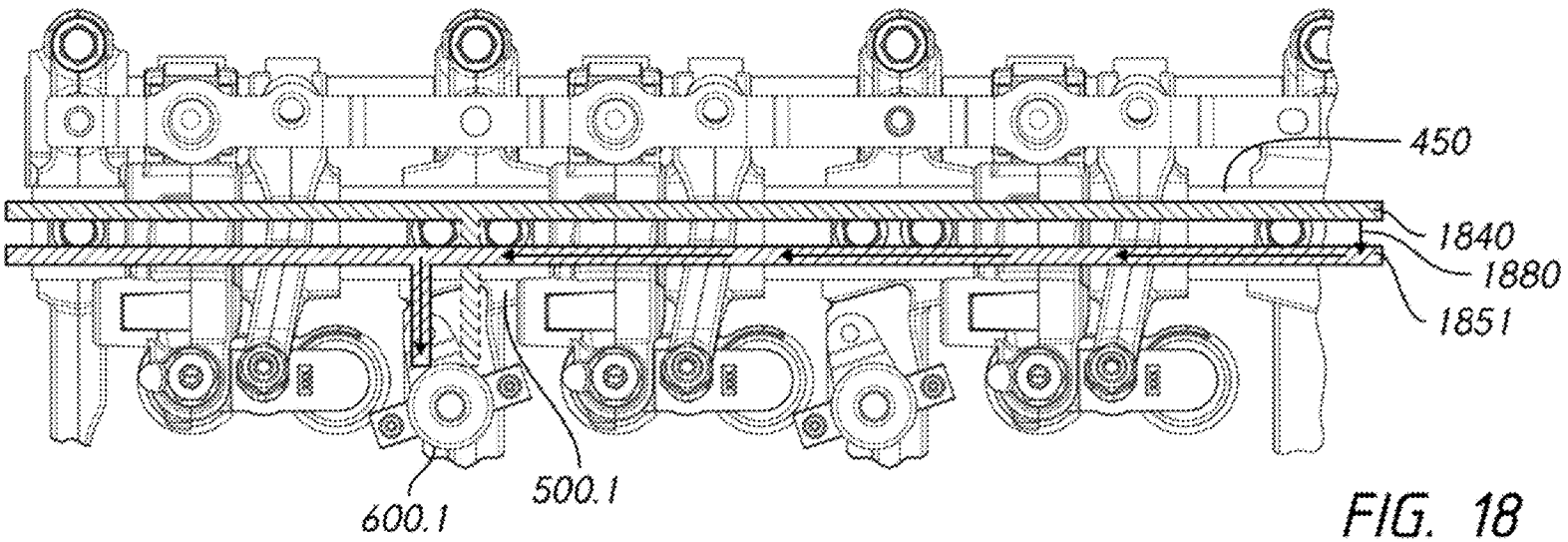
FIG. 18 is a pictorial representation of a top view of an engine overhead environment having a rocker shaft with supply and braking passages therein, rocker arms, solenoids and an example conditioning circuit with a supplemental flow passage at one end of the rocker shaft according to aspects of the disclosure.

According to aspects of the disclosure, the brake activation circuit and lost motion circuit may each be provided with a control valve, such as a three-way solenoid valve for controlling and providing independent control of each hydraulic circuit. Referring additionally to FIG. 18, these solenoid valves 600 may be located on rocker pedestals 500, which may typically include rocker shaft journals for supporting the rocker shaft 450. Rocker pedestals 500 may include internal passages for fluid communication between the solenoid valve inlets and outlets and other components in the hydraulic circuits described herein.

Figure 7:
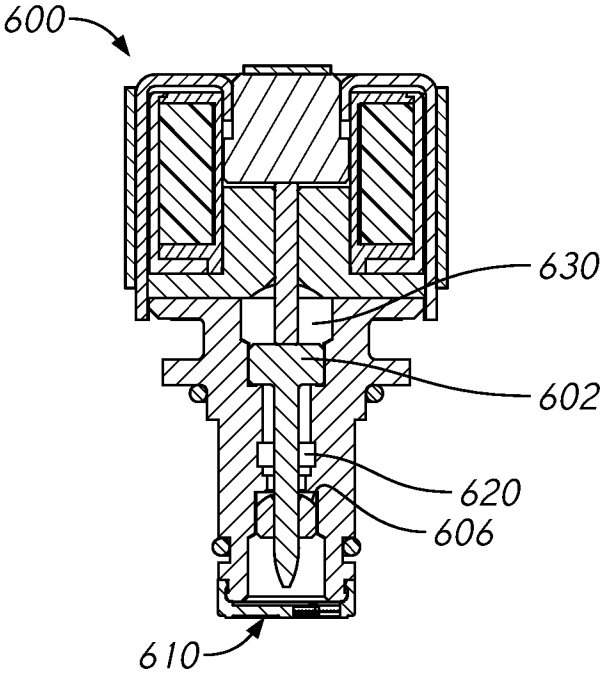
FIG. 7 is cross-section of a three-way solenoid valve of FIG. 6 in an energized mode.
Figure 6:
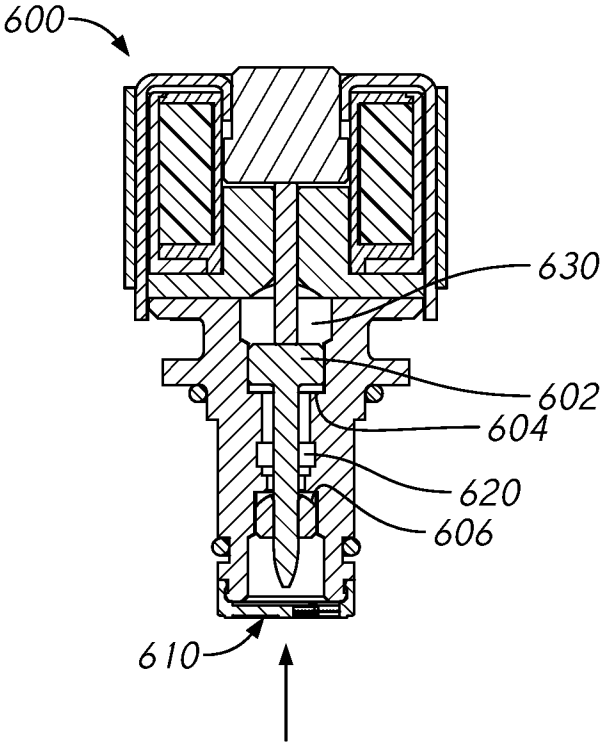
FIG. 6 is a cross-section of a three-way solenoid valve suitable for implementing aspects of the disclosure in a de-energized mode.

FIGS. 6 and 7 illustrates an example three-way solenoid valve 600 suitable for implementing aspects of the instant disclosure in a de-energized state and energized state, respectively. SV 600 may include an internal conductive coil winding, which actuates an armature, which in turn, actuates a valve head 602 to thereby selectively open/close a fluid passage gap across an upper seat 604 and a lower seat 606. Valve head 602, may control flow from valve inlet 610 to a valve outlet port 620 and valve vent port 630. Inlet 610 may be connected to a source of pressurized oil/hydraulic fluid, typically present in an engine overhead, cylinder head, cam carrier, rocker shaft or oil manifold environment. The inlet 610 may normally be closed in the de-energized state, preventing flow of oil from the supply through the valve 600. Outlet port 620 may be connected to a brake or lost motion supply hydraulic circuit including one or more passages in the valvetrain. Connection of the SV 600 to the valvetrain passages may be via a manifold or housing. Typically, oil may be supplied to the valve inlet 610 from a lubrication channel in the rocker shaft. A solenoid manifold may connect the solenoid inlet 610 to the rocker shaft lubrication channel. The outlet port 620 may be in fluid communication with and selectively activate the lost motion or braking circuit, including passages in the rocker shaft as described above. When the SV 600 is in a de-energized state, outlet port 620 is connected to the vent port 630 to depressurize the braking or lost motion circuit. Vent port 630 may be a normally opened (NO) vent port having an open position when the SV 600 is in the de-energized state, thereby venting oil from the outlet port circuit to the ambient environment, (atmospheric pressure) typically under the engine valve cover.

FIG. 7 illustrates the solenoid valve 600 in an energized state. Electrical voltage is applied to the coil/winding to cause the valve head 602 to move downward, opening the lower seat 606 and allowing fluid to pass from the inlet 610 to the outlet port 620. At the same time the upper seat 604 is closed, preventing the venting of oil from the outlet or the supply. In prior art systems, the brake/lost motion circuits are completely independent when the solenoid is off (de-energized), i.e., the supply circuit is not connected to the brake/lost motion circuit when the solenoid valve is de-energized.

Figure 9:
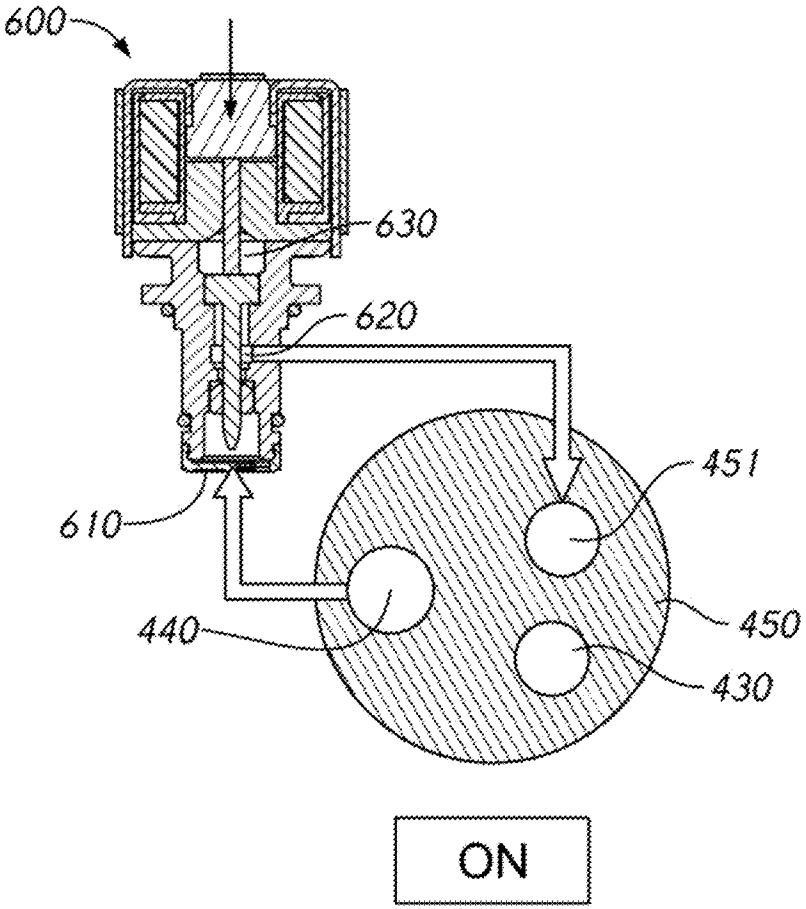
FIG. 9 is a schematic illustration of the components of FIG. 8, with the solenoid valve in an energized mode.
Figure 8:
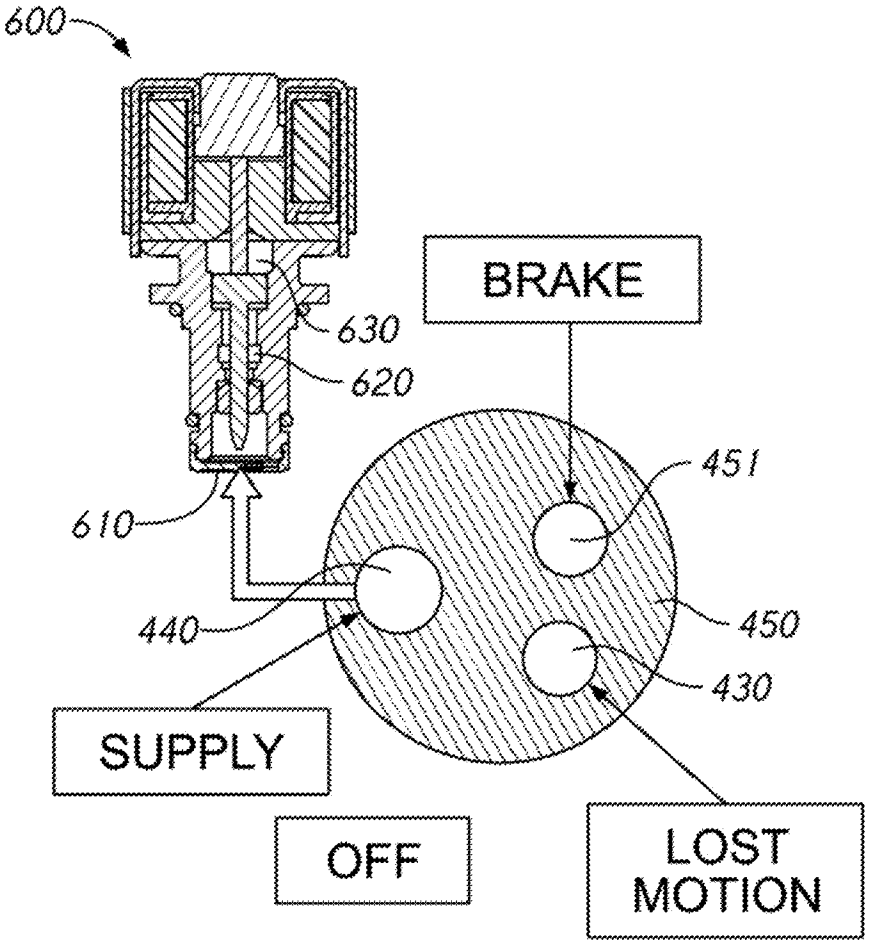
FIG. 8 is a schematic illustration of a solenoid valve and rocker shaft, having supply, braking and lost-motion passages suitable for implementing aspects of the disclosure, with the solenoid valve in a de-energized mode.

FIG. 8 schematically illustrates a de-energized solenoid valve 600 in a prior art configuration. In the de-energized state, hydraulic fluid/oil may flow from the rocker shaft supply passage 440 to the solenoid inlet 610. However, the solenoid valve 600, while venting the rocker control circuit thru the vent port 630, prevents flow from the rocker shaft supply passage 440 to the outlet port 620 and thus prevents flow from the supply to the brake circuit rocker passage 451 or the rocker lost motion control passage 430 in the rocker shaft 450. FIG. 9 schematically illustrates the solenoid valve 600 in an energized state and a corresponding activation mode of the braking circuit. Solenoid valve 600 permits flow from the inlet 610 to the outlet port 620 and thus flow of hydraulic fluid from the supply passage 440 to the brake circuit rocker passage 451, while preventing flow from the solenoid vent 630.

Figure 11:
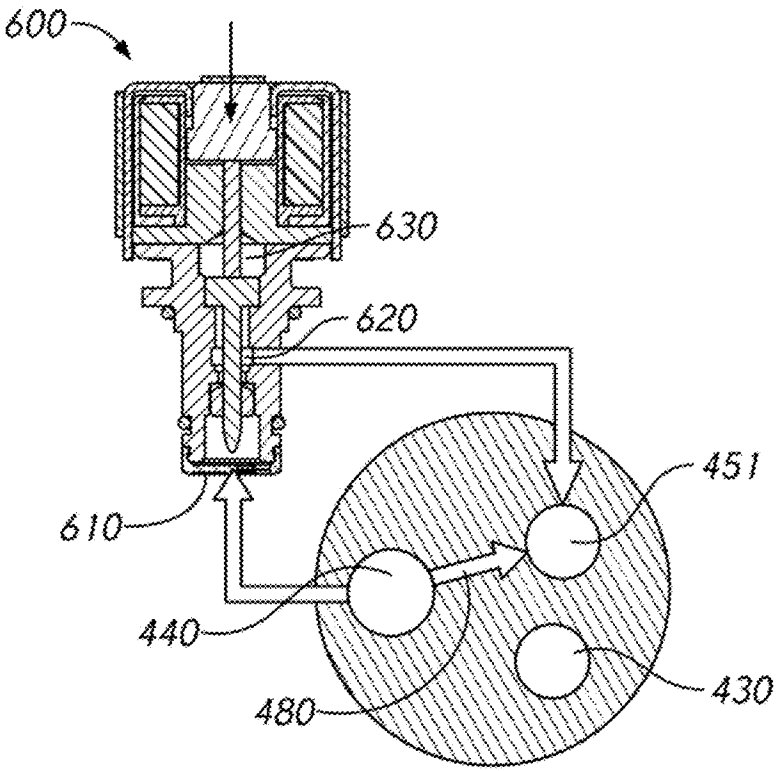
FIG. 11 is a schematic illustration of the solenoid valve and rocker shaft configuration of FIG. 10 with the solenoid valve in an energized mode.
Figure 10:
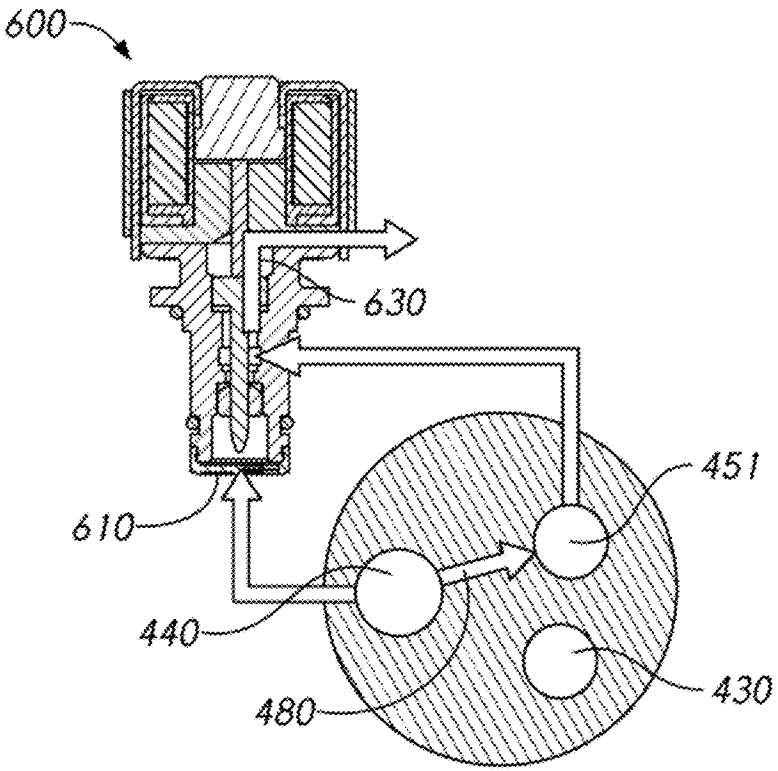
FIG. 10 is a schematic illustration of a solenoid valve and rocker shaft configuration having a conditioning circuit according to aspects of the disclosure, with the solenoid valve in a de-energized mode.

FIGS. 10 and 11 schematically illustrate a system having a conditioning hydraulic circuit, and operation thereof, according to aspects of the disclosure. As will be recognized from the instant disclosure, such a system may have improved responsiveness and consistency in operation of the braking and lost motion hydraulic circuits. Other benefits may include improved oil pressure rise and oil filling time in the hydraulic circuits, as well as increased flow. Conditioning circuit may include a continuous and supplemental supply of oil/hydraulic fluid to branches of the braking and lost motion circuits, as well as a venting of the circuits to ambient, such that the hydraulic fluid in these circuits is kept in a refreshed and conditioned state when the circuits are dormant or in an inactive or deactivated state or mode of operation. In this manner, when the solenoid is in a de-energized state shown in FIG. 10, the braking and lost motion circuits are purged with fresh hydraulic fluid and air may be purged from the circuits in a continuous manner before they are called upon to be activated by action of the solenoid valve (energization). However, the brake/lost motion circuits will not be activated by the conditioning circuit fluid supply because the pressure in the parallel supply is insufficient to activate these circuits and/or associated hydraulic braking and/or lost motion components. The pressure in the parallel supply may be reduced, in part, due to the venting function of the solenoid valve 600, and may be further controlled with components in the conditioning circuit, as will be described, to remain below a threshold level during the deactivated mode of operation of the solenoid valve. The supplemental supply may preferably be facilitated by a flow path 480 between the continuous oil supply passage 440 and one, as in FIG. 10, or both of the braking and lost motion passages 451 and 430 Venting may also preferably be facilitated by the same solenoid valve to provide for venting pressure/fluid from the circuit using the open solenoid venting port on the de-energized solenoid. Due to the parallel supply of oil and the resulting purging of air from the circuit, the system is able to provide consistent turn-on response time and consistent hydraulic working fluid composition (i.e., elimination or reduction of air or gas bubbles).

FIG. 11 schematically shows the system flows when the solenoid is energized to activate the braking circuit. In this mode, the solenoid valve vent port 630 is closed and fluid flow through solenoid valve occurs from the inlet supply passage 440 to the outlet port 620 and thus to the braking circuit flow passage 451. During this activated mode of operation of the solenoid valve 600, the conditioning circuit may continue to supply oil to the braking circuit through path 480. As will be recognized, owing to aspects of the instant disclosure, the conditioning circuit may provide the benefit of increased flow into the brake and lost motion circuits when the system is active due to the additional flow from the conditioning circuit parallel path/supply of oil into the circuit. Stated another way: oil will flow through the normal solenoid supply circuit, and also through the parallel circuit to improve filling of the brake/lost motion actuators. This added supply improves flow rate into the brake circuit when the solenoid is energized, thus facilitating the use of a lower flow (and likely lower cost) solenoid valve to activate the braking/lost motion circuits than would otherwise be required.

Figure 12:
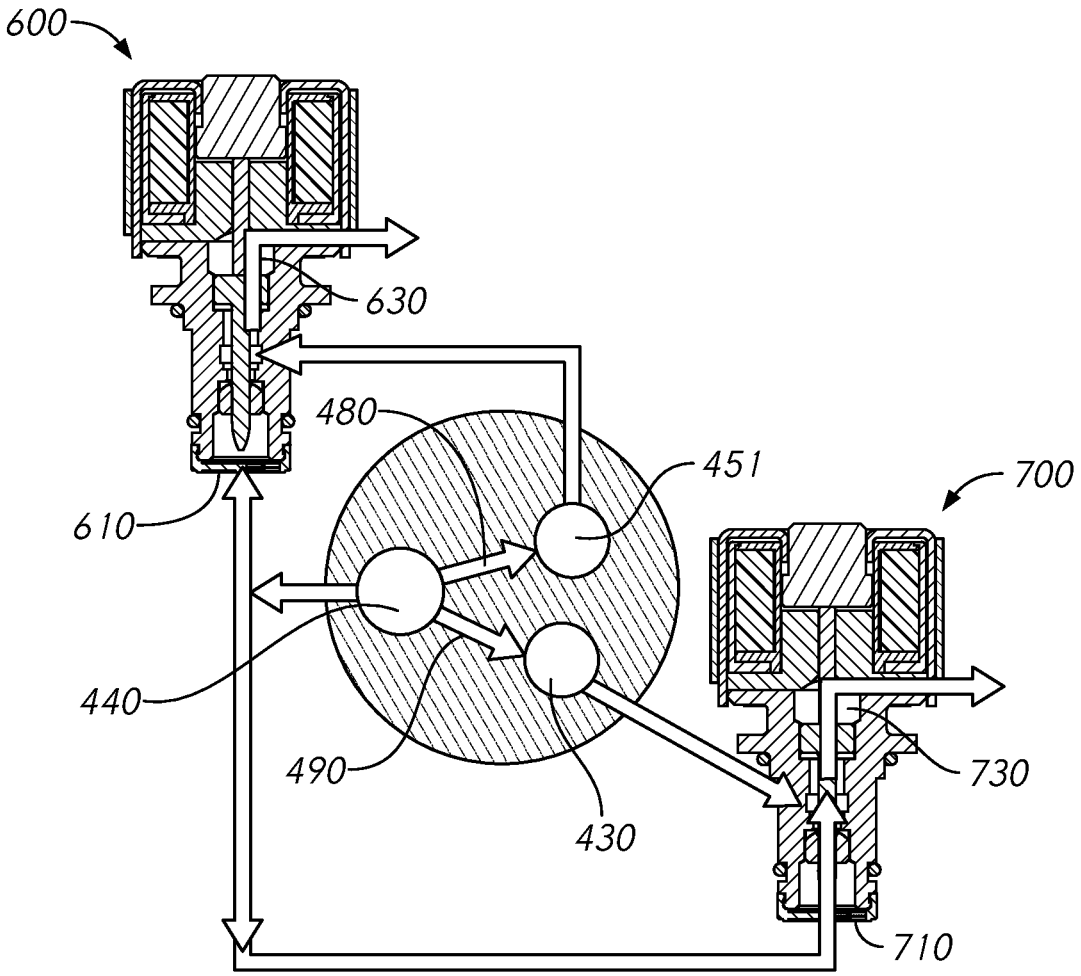
FIG. 12 is a schematic illustration of a rocker shaft having two example conditioning circuits, one each for a braking circuit and a lost motion circuit, with the solenoids in a de-energized mode.
Figure 13:
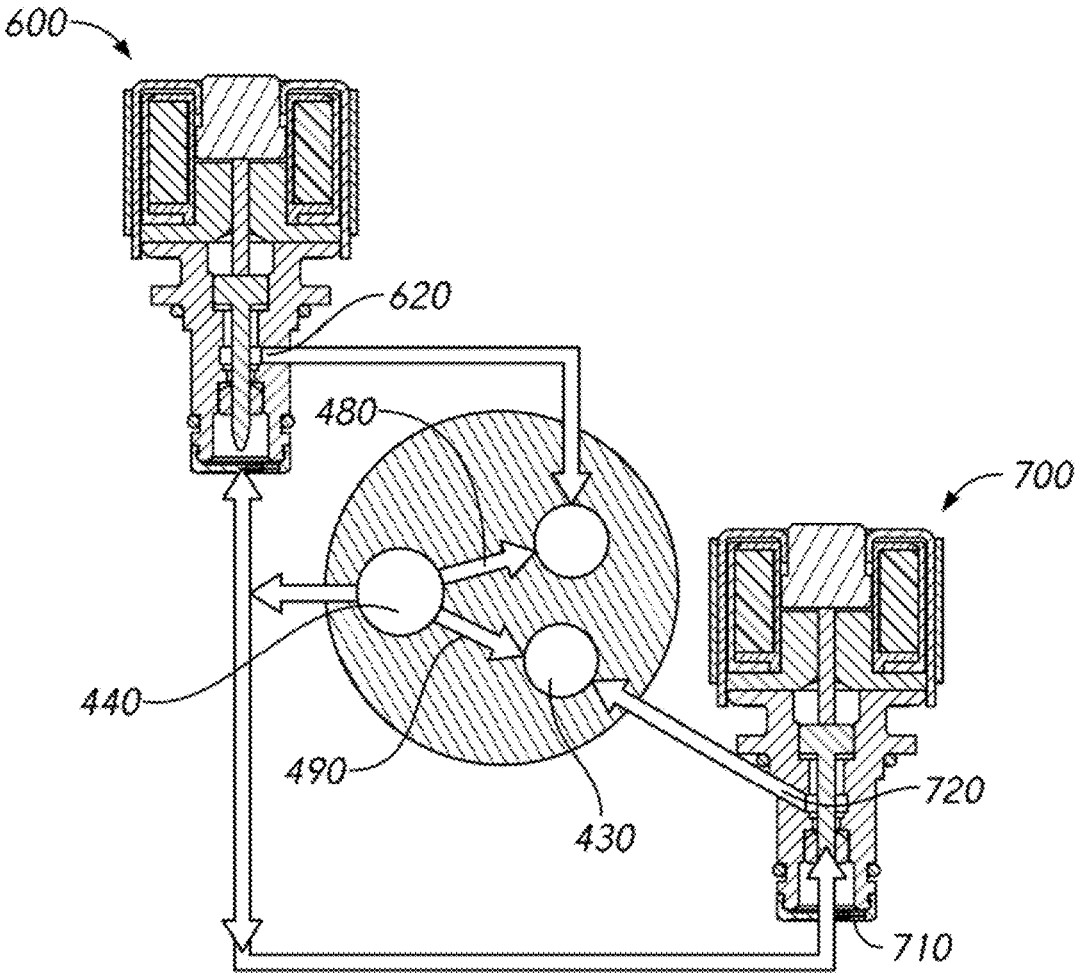
FIG. 13 is a schematic illustration of a rocker shaft having two example conditioning circuits, one each for a braking circuit and a lost motion circuit, with the solenoids in an energized mode.

FIGS. 12 and 13 schematically illustrate a conditioning circuit configuration for two lost motion/braking circuits. In this case, respective supplemental supply sources are provided by supplemental flow passages 480 and 490 to the braking circuit rocker passage 451 and the rocker lost motion control passage 430. Respective solenoid valves 600 and 700 are provided, each having an inlet 610 and 710 in fluid communication with the supply passage 440. FIG. 12 shows the solenoids 600 and 700 in a de-energized state, with the respective conditioning circuit supplemental flow paths 480 and 490 providing flows to braking passage 451 and lost motion control passage 430, which, in turn, each vent to the respective venting ports 630 and 730 of the associated solenoids 600 and 700. FIG. 13 shows the solenoids 600 and 700 in an energized state, with the supplemental flow passages 480 and 490 continuing to provide flow to the braking passage 451 and lost motion control passage 430 in addition to the activation flows provided from the respective outlet ports 620 and 720 of the solenoids 600 and 700.

As will be recognized from the instant disclosure, in conditioning circuit configurations according to aspects of the disclosure, the supply oil pressure may be maintained at a continuous pressure and the selective actuation circuits for brake/lost motion may be activated/deactivated by the solenoid valves as described above. As described above, the solenoids may be mounted in or on an engine pedestal, two or more pedestals being provided with supporting/mounting structure for the rocker shaft, such as rocker journals, having internal lubrication and/or hydraulic passages. Alternatively, the solenoids may be mounted in other locations on or in the vicinity of the engine cylinder head with appropriate passages or conduits for conveying hydraulic fluid to the braking and lost motion circuits. The solenoids may receive oil from the continuous supply circuit in the rocker shaft and return it to the shaft braking and lost motion passages. Alternatively, the solenoids may receive oil from another supply/source within the engine, or even external to it and supply it to the shaft braking and lost motion passages. As will be recognized, dedicated oil supply passages for each solenoid may improve the conditioning provided by the respective conditioning circuit and improve response times and response consistency.

According to aspects of the disclosure, and as will be apparent from this description, variants on the general conditioning circuit configurations described above may be provided. For example, the supplemental fluid supply paths to the hydraulic circuits and the venting passages may take other forms or have other locations within the respective circuits. In addition, flow control components, such as orifices, check valves and regulating devices may be used in conjunction with, or as part of, the conditioning circuit.

Figure 14:
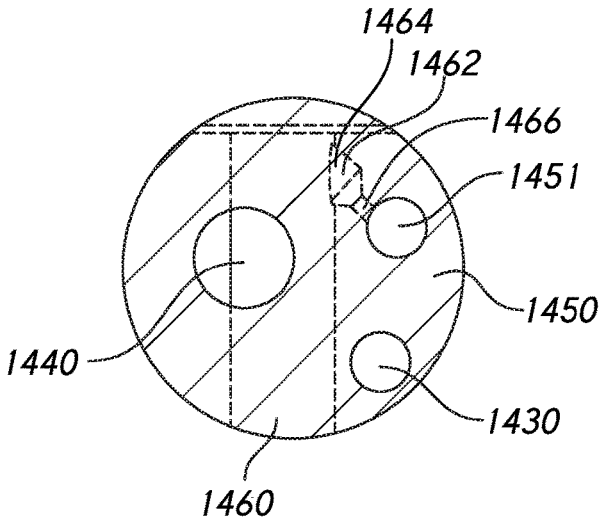
FIG. 14 is a cross-section of a rocker shaft having another example conditioning circuit.
Figure 15:
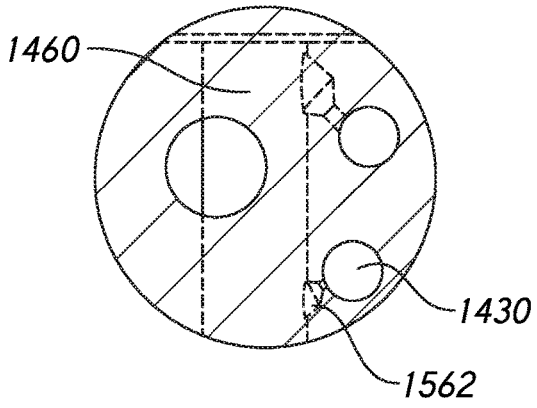
FIG. 15 is a cross-section of a rocker shaft having yet another example conditioning circuit.

FIGS. 14 and 15 illustrate respective related variants according to aspects of the disclosure. FIG. 14 shows a rocker shaft 1450 in cross-section and having a mounting through hole 1460 therein. Through hole 1460 may be for receiving a threaded hold-down bolt/fastener to secure the rocker shaft to a rocker shaft pedestal and/or rocker shaft journal. Through hole 1460 may extend through the rocker supply passage 1440 and provide fluid communication therewith. A branch passage 1462 may be provided from the through hole 1460 to the braking fluid passage 1451 in the rocker shaft 1450. Branch passage 1462 may comprise a single small bore, or may comprise (as shown) a larger bore 1464 tapering to a smaller bore or orifice 1466 to provide favorable flow control. Alternatively, a preconfigured orifice may be press fit into the larger bore 1464. The larger bore 1464 and smaller bore 1466 may be conveniently manufactured using an angled drilling into the sidewall of through hole 1460. FIG. 15 illustrates a similar branch passage 1562 extending from through hole 1460 to rocker lost motion control passage 1430. As will be recognized, the through hole 1460, even if occupied by a hold-down bolt, owing to its location relative to supply passage 1440 and as facilitated by the branch passage 1462 and/or 1562 provides for a parallel path/supplemental flow passage of hydraulic fluid from the supply passage 1440 to the braking passage 1451 and/or lost motion control passage 1430. Thus, according to this configuration, the conditioning circuit(s) can be implemented at very low cost and as a fairly quick and easy retrofit adaptation of existing braking and lost motion hydraulic circuit structure.

Figure 16:
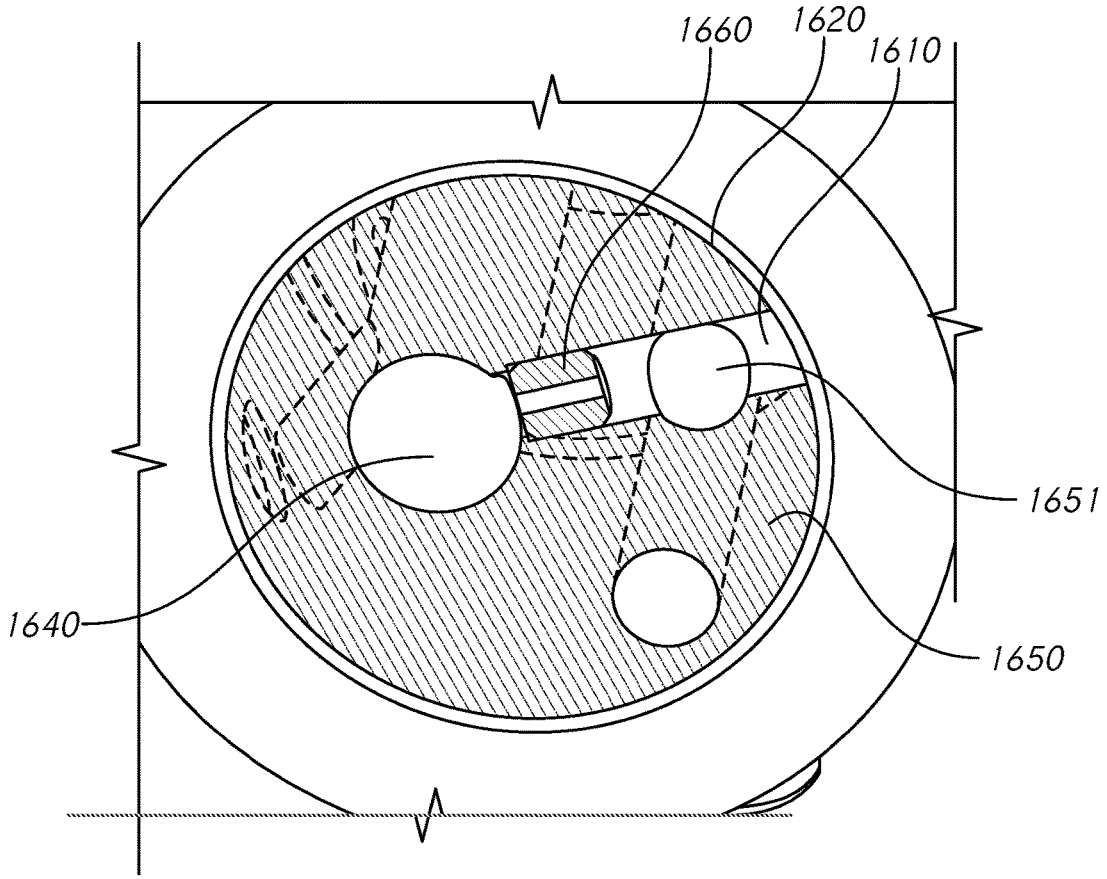
FIG. 16 is a cross-section of a rocker shaft having yet another example conditioning circuit including an orifice as a flow control device.

FIG. 16 illustrates another variant according to aspects of the disclosure. In this example, a conditioning circuit supplemental supply path may be provided by a bore 1610 is drilled in the rocker shaft 1650 through the braking circuit passage 1651 to a depth that penetrates the wall of the supply passage 1640, providing fluid communication between the supply passage 1640 and the braking circuit passage 1651. A preconfigured orifice 1660 may be press-fit into the bore 1610 to provide for flow control in the conditioning circuit. As will be recognized, in this configuration, the location of the bore 1610 axially on the rocker shaft 1650 is selected such that entry of bore 1610 is sealed by the rocker arm bushing 1620 once the rocker arm is installed therein. This seals the bore 1610 eliminates the need for (and cost of) a plug or cap for the bore 1610 to prevent undesirable outflow.

Figure 17:
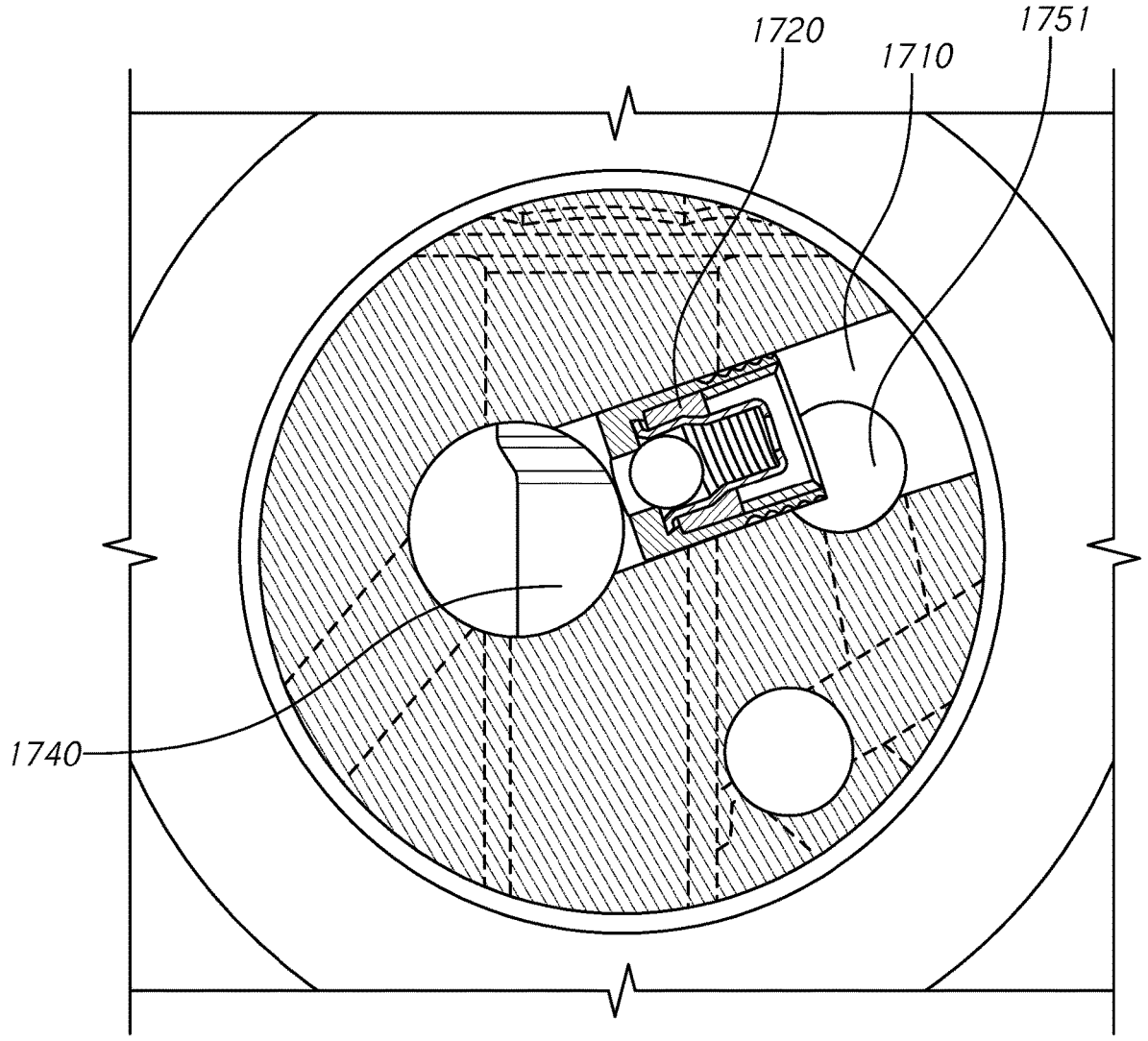
FIG. 17 is a cross-section of a rocker shaft having yet another example conditioning circuit including a relief/check valve as a flow control device.

Other variants, according to aspects of the disclosure, may be suitable for providing improved conditioning circuits in environments where there may be challenges in maintaining oil pressure at low engine speeds. For example, in engines with marginal oil supply to the cylinder head, especially at low engine speeds, oil pressure may drop below levels needed for effective operation of the conditioning circuit. Positive displacement oil pumps commonly used in internal combustion engines have a lower output at low rpm due to leakage such that pressure can drop below acceptable levels. Moreover, the additional demands placed on the oil supply by one or more conditioning circuits at idle condition or low rpm may have unacceptable impact on the operation of the braking and lost motion circuits. According to aspects of the disclosure, conditioning circuits may be provided with pressure and/or flow control components to eliminate oil demand by the conditioning circuit below a pressure threshold. FIG. 17 illustrates an example implementation that utilizes a spring-loaded relief device 1720 to prevent flow in the supplemental flow passage of the conditioning circuit below a threshold pressure. The relief device 1720 may be installed as a unit into a bore 1710 in the rocker shaft 1750 providing fluid communication between the supply passage 1740 and the braking circuit passage 1751. The relief device 1720, which may be a ball and spring type check valve with a seating surface, prevents flow into the braking circuit unless a predetermined threshold pressure (cracking pressure) is established in the supply passage 1740. This configuration prevents leakage from the conditioning circuit at low pressures. It can also prevent drain back (backflow) of oil through the bleed circuit when the engine is off, which may be advantageous for lost motion systems that require full functionality at or soon after engine startup.

Other variants according to aspects of the disclosure may include providing flow restricting orifices within the structure of the solenoids themselves, or having deliberate and controlled internal bleed or leaking within the solenoid.

These, however, may be less desirable because of the close proximity of the supply and vent in the solenoid valve structure.

Figure 19:
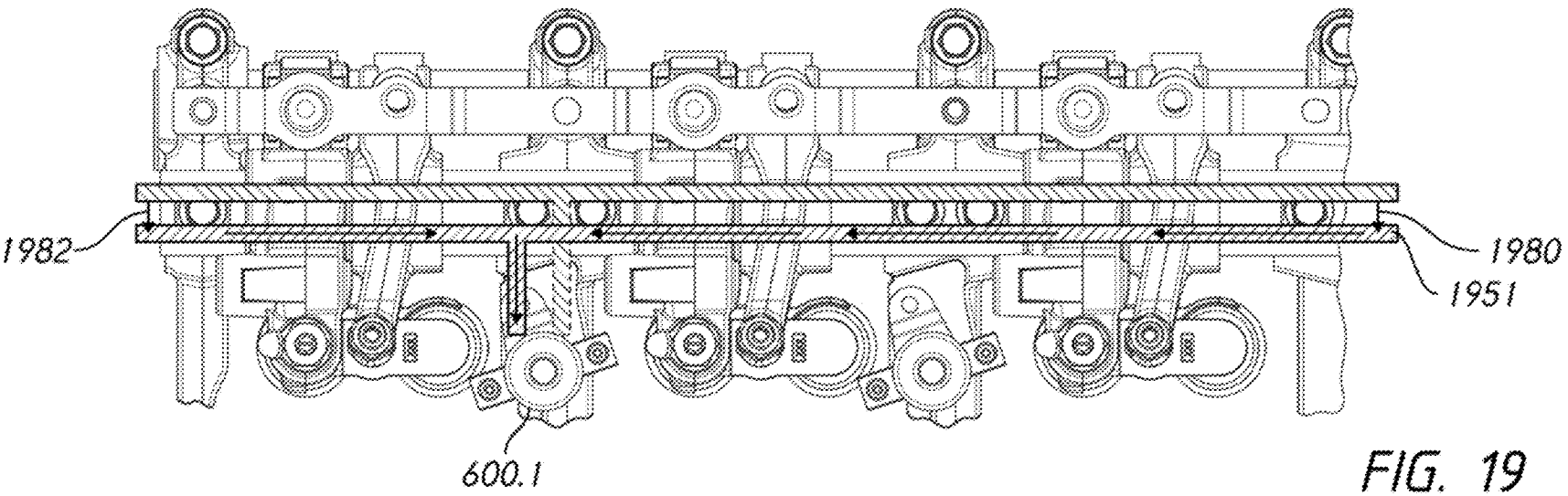
FIG. 19 is a pictorial representation of a top view of an engine overhead environment having a rocker shaft with supply and braking passages therein, rocker arms, solenoids and another example conditioning circuit with supplemental flow passage at opposite ends of the rocker shaft according to aspects of the disclosure.

Aspects of the disclosure also provide for locating components of the conditioning circuits at specific locations within an engine or engine overhead environment. It may be desirable to have at least one of the supplemental supply flow paths located at one end of the braking or lost motion circuit and the solenoid located at an opposite end thereof. FIG. 18 illustrates a configuration in which the supplemental supply flow path 1880 from the rocker shaft supply passage 1840 to the rocker shaft braking passage 1851 is located at a far end (right side of FIG. 18) of the rocker shaft being a sufficient distance from the location of the solenoid 600.1 that receives and vents oil from the braking circuit rocker passage 1851 via passages in the pedestal 500.1. This permits more thorough air purge from the braking circuit since conditioned hydraulic fluid from the conditioning circuit travels a larger distance and may affect a majority of the fluid within the braking circuit before venting to through the solenoid valve 600.1. FIG. 19 schematically illustrates another example where two supplemental supply flow passages 1980 and 1982 are provided at ends of the rocker shaft, the control solenoid valve 600.1 being located in the same place as in FIG. 18. This example configuration may provide improved air bleed due to purging of air from both the left and the right ends of the braking passage 1951 in the rocker shaft.

Figure 20:
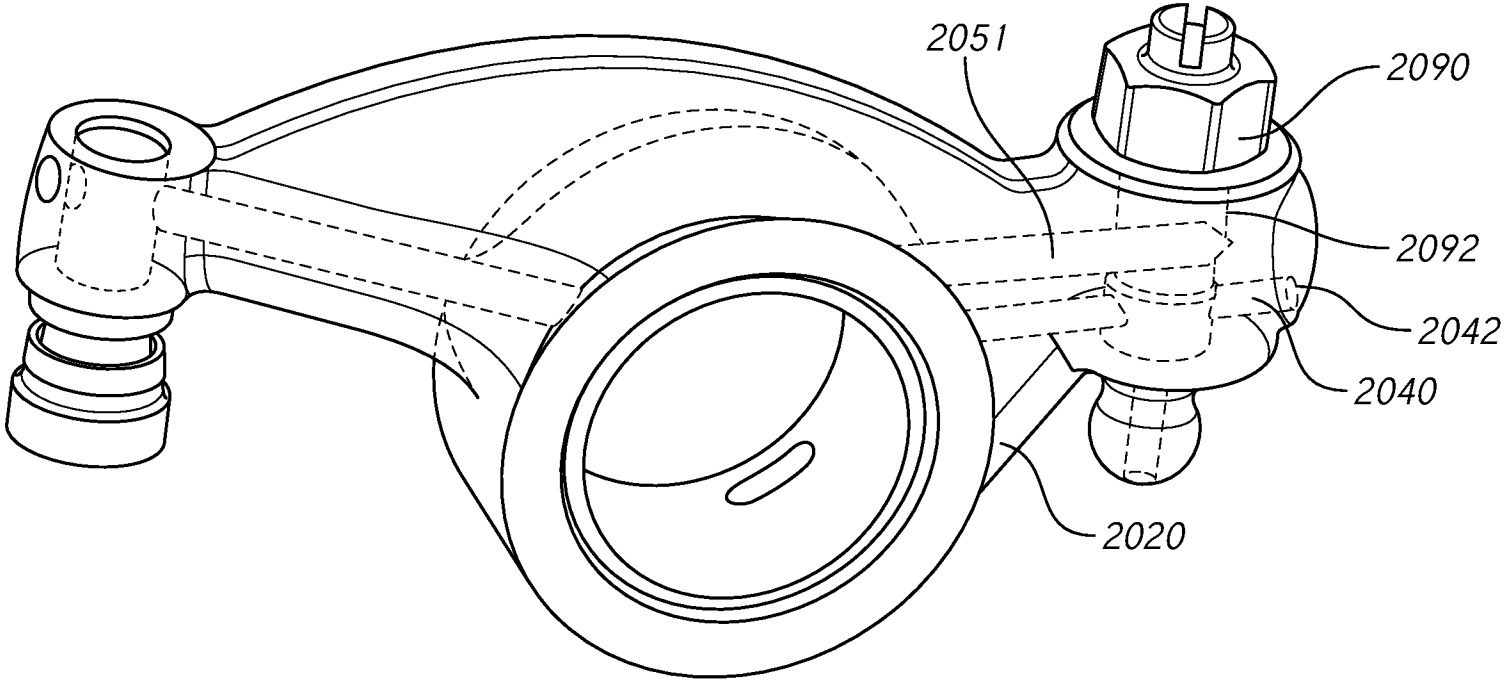
FIG. 20 is a pictorial view of a rocker arm having an example supplemental flow passage therein according to aspects of the disclosure.

According to further aspects of the disclosure, the hydraulic conditioning circuits may be facilitated by supplemental flow passages provided in additional components in an engine valvetrain. For example, supplemental flow passages may be provided in the solenoid manifold, which may have internal passages for respective connection of the solenoid valve ports and vent to corresponding passages in the rocker pedestal. For further example, supplemental flow passages may be provided in the rocker arm in the valvetrain. FIG. 20 illustrates an example of a pushrod rocker arm 2020 with a lash adjusting screw 2090. According to aspects of the disclosure, the lash adjusting screw 2090 may extend in a threaded bore 2092 within the rocker arm 2020 in a location that provides fluid communication between a rocker arm fluid supply passage 2040 and a rocker arm braking fluid control passage 2051. The small clearances between the lash adjusting screw threads and the threads in the bore 2092 may be dimensioned so as to provide a restricted supplemental fluid flow passage from the supply passage 2040 to the braking passage 2051. A ball plug 2042 may be provided in the end of the supply passage 2040 to block flow therefrom, once the supply passage 2040 is machined/drilled into the rocker arm. This configuration thus facilitates a conditioning circuit having a supplemental fluid flow passage in the rocker arm.

Figure 21:
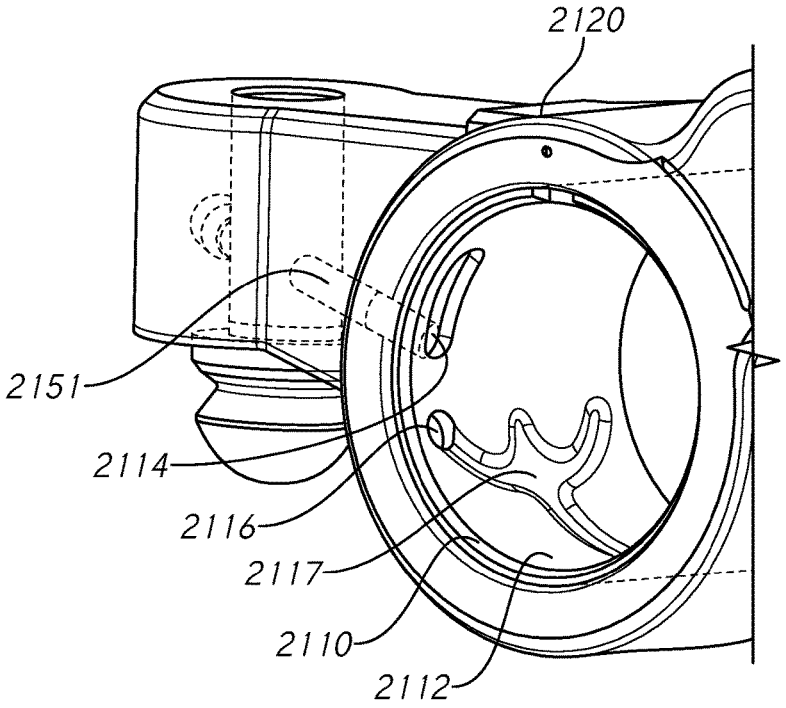
FIG. 21 is a pictorial view of a rocker arm/rocker shaft interface having an example supplemental flow passage therein according to aspects of the disclosure.

FIG. 21 illustrates an additional example according to aspects of the disclosure in which the supplemental flow passage for a hydraulic conditioning circuit is provided across the interface between a rocker arm and rocker shaft. An inside bore 2110 of the rocker arm 2120 may include a bushing 2112 that may be press-fit therein. Bushing 2112 may include a through passage 2114 which permits fluid flow to or from a lost motion control passage 2151, which may control a lost motion component in an associated pushrod or in another component in the valvetrain. Another passage 2116 through the bushing 2112 may provide for the flow of fluid from a lubrication channel 2117 on the interior surface of the bushing 2112. Alternatively, channels or passages may be formed or machined directly into the inside bore 2110 of the rocker arm 2120. The proximity of the lubrication channel 2117, passage 2116 and passage 2114 may permit cross-flow, within the rocker shaft/bushing interface, or within the rocker shaft/rocker arm interface, of lubricating fluid from the supply passage(s) to the braking circuit passage(s). This configuration may thus provide a supplemental flow passage within the rocker shaft/rocker arm interface, which, in turn, facilitates a hydraulic conditioning circuit. As an additional variant, a groove may be added to the bearing, or an orifice provided to regulate flow within the supplemental flow passage.

It will be recognized from the instant disclosure that other components or devices for flowing oil or hydraulic fluid from a supply circuit or passage to a lost motion and/or braking circuit or passage may be utilized within the scope and spirit of the disclosure. For example, if it may be desirable to have a clean oil supply to the braking/lost motion circuits, filtering components, such as screens, sintered elements, or edge filters, or even fine passages, within or in combination with the supplemental flow passage(s) described herein.

In an implementation of the instant disclosure, applicants have found that a flow rate of 0.3 liters per minute at a pressure of 1 to 2 bar has been adequate to provide a 25% improvement in turn on response and reduction in response variation in a typical installation having a single solenoid to supply three brake actuators. Even lower flow rates of about 0.1 liters per minute may in some cases be adequate to eliminate variability in turn on response times, however the turn on time improvement may not improve as significantly.

Figure 22:
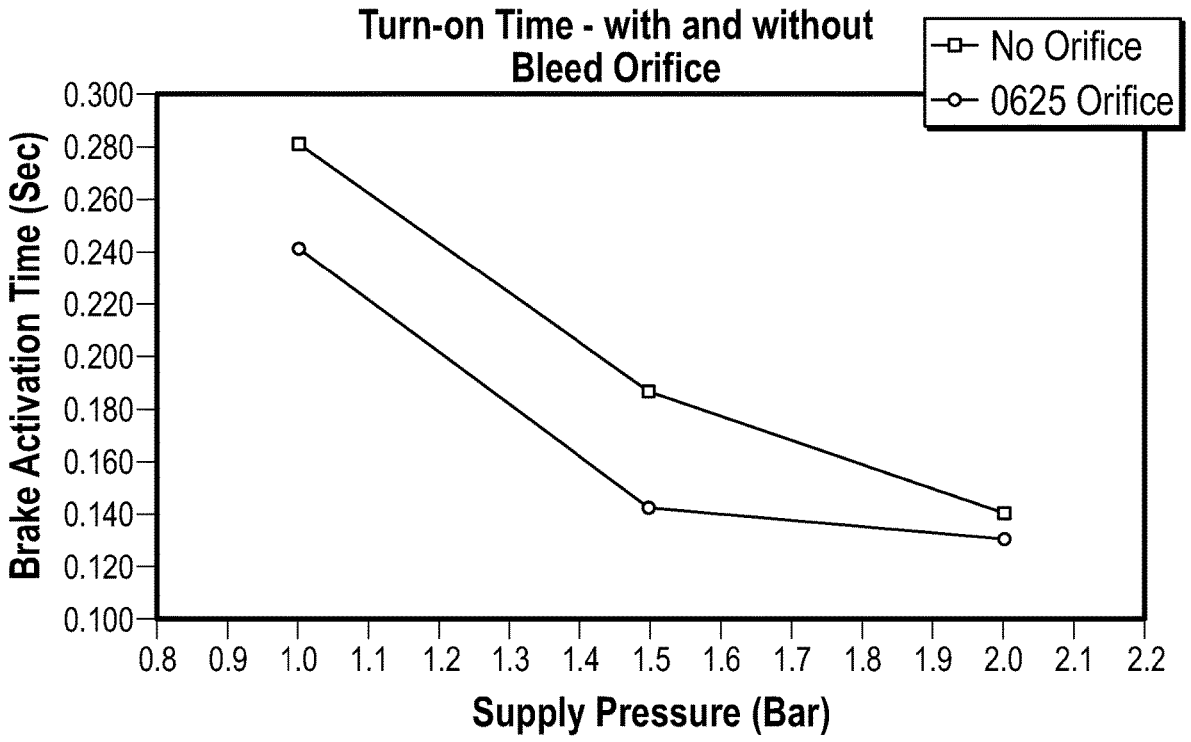
FIG. 22 is a graphical representation of improved turn on response times achieved according to aspects of the disclosure.

FIG. 22 is a graphical representation of data obtained from a system with a controlled bleed orifice in a supplemental flow passage feeding a braking circuit from a supply circuit. This figure shows up to a 23 percent improvement in response time at 1.5 bar pressure. Larger improvements may be possible with higher flow orifices, but possibly at the expense of additional oil consumption from the circuit. Such additional oil consumption may be acceptable, particularly in larger engine environments.

Although the present implementations have been described with reference to specific example embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A system for actuating at least one engine valve in an internal combustion engine comprising:

a valvetrain for conveying motion from a motion source to the at least one engine valve, the valvetrain including: a rocker arm mounted on a rocker shaft and a lost motion component;

a control valve for controlling the lost motion component, the control valve having an inlet for receiving hydraulic fluid from a hydraulic fluid supply source;

the rocker shaft having a rocker shaft lost motion control flow passage for conveying hydraulic fluid between the control valve and the lost motion component, the rocker shaft having a rocker shaft supply passage for receiving hydraulic fluid from the hydraulic fluid supply source, the rocker shaft supply passage and rocker shaft lost motion control flow passage extending within an interior of the rocker shaft;

the control valve having an activated mode, wherein the control valve permits an activation flow of hydraulic fluid in the lost motion control flow passage, and a deactivated mode, wherein the control valve prevents the activation flow in the lost motion control flow passage;

a conditioning circuit adapted to provide a supplemental flow of hydraulic fluid in the lost motion control flow passage when the control valve is in the deactivated mode, the conditioning circuit including a vent for venting the supplemental flow from the lost motion control flow passage;

wherein the conditioning circuit comprises a supplemental flow passage providing fluid communication between the rocker shaft supply passage and rocker shaft lost motion control flow passage, the supplemental flow passage being disposed outside the interior of the rocker shaft.

2. The system of claim 1, wherein the rocker arm includes a rocker arm supply passage for receiving hydraulic fluid from the hydraulic fluid supply source and a rocker arm lost motion control flow passage, wherein the supplemental flow passage connects the rocker arm supply passage to the rocker arm lost motion control flow passage.

3. The system of claim 2, wherein the supplemental flow passage is provided by a threaded fastener extending in the rocker arm lost motion control flow passage.

4. The system of claim 1, further comprising a control valve manifold having a manifold inlet flow passage for conveying hydraulic fluid to the control valve and a manifold outlet flow passage for conveying hydraulic fluid from the control valve, wherein the supplemental flow passage connects the manifold outlet flow passage and the manifold inlet flow passage.

5. The system of claim 1, wherein the control valve further comprises a control valve outlet, wherein the supplemental flow passage connects the control valve outlet to the control valve inlet.

6. The system of claim 1, wherein the conditioning circuit further comprises a flow control component for controlling the supplemental flow.

7. The system of claim 6, wherein the flow control component comprises a restricted flow passage.

8. The system of claim 7, wherein the restricted flow passage comprises a clearance passage between a screw and threads in a bore in the rocker arm.

9. The system of claim 1, wherein the lost motion component has an activation pressure, and wherein the conditioning circuit further comprising a regulating component that is adapted to maintain the conditioning circuit at a conditioning circuit pressure below the activation pressure of the lost motion component.

10. The system of claim 1, wherein the control valve comprises a three-way solenoid valve.

11. The system of claim 1, wherein the conditioning circuit is configured to provide the supplemental flow when the control valve is in the activated mode.

12. The system of claim 1, wherein the lost motion component is a lost motion valve bridge.

13. The system of claim 1, wherein the supplemental flow passage is disposed proximate an end of the rocker shaft.

14. The system of claim 13, wherein the rocker shaft has an axial length, and wherein the control valve is positioned a distance from the supplemental flow passage that is at least half of the rocker shaft axial length.

15. The system of claim 1, wherein the conditioning circuit includes at least one channel formed in a rocker bushing.

16. The system of claim 1, wherein the lost motion component is located in a pushrod in the valvetrain.

17. The system of claim 1, wherein the lost motion component is adapted to selectively absorb motion from the motion source and thereby facilitate modification of main event motion that the motion source would otherwise impart to the engine valve.

18. The system of claim 1, wherein the supplemental flow provided by the conditioning circuit is continuous.

19. The system of claim 1, wherein the supplemental flow provided by the conditioning circuit is continuous from a supply source to a brake or lost motion supply hydraulic circuit.

20. The system of claim 1, wherein the conditioning circuit is adapted to purge a braking or lost motion circuit with fresh hydraulic fluid in a continuous manner before the braking or lost motion circuit is called upon to be activated by action of the control valve.

21. The system of claim 1, wherein the conditioning circuit further comprises a flow path through an interface between the rocker shaft and rocker arm.

22. The system of claim 1, wherein the conditioning circuit further comprises a flow path through an interface between the rocker shaft and a rocker arm bushing.

23. A system for actuating at least one engine valve in an internal combustion engine comprising:

a valvetrain for conveying motion from a motion source to the at least one engine valve, the valvetrain including: a rocker arm mounted on a rocker shaft and a lost motion component;

a control valve for controlling the lost motion component, the control valve having an inlet for receiving hydraulic fluid from a hydraulic fluid supply source;

the rocker shaft having a lost motion control flow passage for conveying hydraulic fluid between the control valve and the lost motion component;

the control valve having an activated mode, wherein the control valve permits an activation flow of hydraulic fluid in the lost motion control flow passage, and a deactivated mode, wherein the control valve prevents the activation flow in the lost motion control flow passage; and a conditioning circuit adapted to provide a supplemental flow of hydraulic fluid in the lost motion control flow passage when the control valve is in the deactivated mode, the conditioning circuit including a vent for venting the supplemental flow from the control flow passage;

wherein the rocker shaft includes a supply passage for receiving hydraulic fluid from the hydraulic fluid supply source and wherein the conditioning circuit includes at least one supplemental flow passage connecting the rocker shaft supply passage to the rocker shaft lost motion control passage, the supplemental flow passage being located at an interface between the rocker arm and the rocker shaft.

24. The system of claim 23, further comprising a bushing between the rocker shaft and rocker arm, wherein the supplemental flow passage includes a channel in the bushing.

25. The system of claim 23, further comprising a bushing between the rocker shaft and rocker arm, wherein the supplemental flow passage comprises a first passage extending from the rocker shaft supply passage to the interface and a second passage extending from the rocker shaft lost motion control passage to the interface.

26. The system of claim 25, where the first passage and the second passage are sufficiently proximate one another to facilitate crossflow at the interface between the first passage and the second passage.

27. A system for actuating at least one engine valve in an internal combustion engine comprising:

a valvetrain for conveying motion from a motion source to the at least one engine valve, the valvetrain including: a rocker arm mounted on a rocker shaft and a lost motion component;

a control valve for controlling the lost motion component, the control valve having an inlet for receiving hydraulic fluid from a hydraulic fluid supply source;

the rocker shaft having a lost motion control flow passage for conveying hydraulic fluid between the control valve and the lost motion component;

the control valve having an activated mode, wherein the control valve permits an activation flow of hydraulic fluid in the lost motion control flow passage, and a deactivated mode, wherein the control valve prevents the activation flow in the lost motion control flow passage; and a conditioning circuit adapted to provide a supplemental flow of hydraulic fluid in the lost motion control flow passage when the control valve is in the deactivated mode, the conditioning circuit including a vent for venting the supplemental flow from the control flow passage;

wherein the rocker arm includes a rocker arm supply passage for receiving hydraulic fluid from the hydraulic fluid supply source and a rocker arm lost motion control passage, wherein the conditioning circuit includes a supplemental flow passage connecting the rocker arm supply passage to the rocker arm lost motion control passage.

* * * * *